US006545645B1

(12) United States Patent
Wu

(10) Patent No.: US 6,545,645 B1
(45) Date of Patent: Apr. 8, 2003

(54) COMPACT FREQUENCY SELECTIVE REFLECTIVE ANTENNA

(75) Inventor: Te-Kao Wu, Rancho Palos Verdes, CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/394,386

(22) Filed: Sep. 10, 1999

(51) Int. Cl.[7] ..... H01Q 1/28
(52) U.S. Cl. ..... 343/781 P; 343/781 CA
(58) Field of Search ..... 343/781 P, 781 CA, 343/773, 836, 838, 837

(56) References Cited

U.S. PATENT DOCUMENTS

| | | | | |
|---|---|---|---|---|
| 4,342,036 A | * | 7/1982 | Scott et al. | 343/836 |
| 4,701,765 A | * | 10/1987 | Arduini et al. | 343/897 |
| 5,130,718 A | | 7/1992 | Wu | 343/781 CA |
| 5,373,302 A | * | 12/1994 | Wu | 343/781 P |
| 5,576,721 A | * | 11/1996 | Hwang et al. | 343/753 |

FOREIGN PATENT DOCUMENTS

JP 54114065 9/1979

OTHER PUBLICATIONS

Ueno, K., et al, *"Low–Loss Ka–Band Frequency Selective Subreflector,"* Jun. 20, 1991, Electronic Letters, IEE Stevenage, GB, vol. 27, No. 13, p. 1155.

Honma, S., et al., *"Performance Measurement of Frequency Selective Reflector Using Planar Near–Field Techniques,"* Jun. 18, 1995, IEEE Antennas and Propagation Society International Symposium Digest, vol. 3, pp. 1663–1666.

Pelton, Edward L., et al., *"Scattering from Periodic Arrays of Crossed Dipoles,"* May 1979, IEEE Transactions on Antennas and Propagation, vol. AP–27, No. 3, pp. 323–330.

* cited by examiner

*Primary Examiner*—Don Wong
*Assistant Examiner*—James Clinger
(74) *Attorney, Agent, or Firm*—Connie M. Thousand

(57) ABSTRACT

A multi-pattern reflector antenna for generating first and second antenna patterns from first and second RF signals having first and second frequencies of operation respectively. The antenna includes a reflector having a focal point, first and second subreflectors configured to image the focal point at first and second preselected locations respectively; and, first and second feeds positioned at the first and second preselected locations. The first and second feeds are configured to operate at the first and second frequencies of operation respectively and are operative to generate first and second radiated RF signals from the first and second RF signals respectively.

The first and second subreflectors partially overlap each other with the first subreflector configured to be a frequency selective structure which reflects RF signals having the first frequency of operation and passes RF signals having the second frequency of operation. The second subreflector is configured to reflect RF signals having the second frequency of operation and pass RF signals having the first frequency of operation.

19 Claims, 8 Drawing Sheets

COMPACT FREQUENCY SELECTIVE REFLECTIVE ANTENNA

BACKGROUND OF THE INVENTION

1. Field of the Invention

The present invention relates to the field of reflector antennas, and more particularly, to a compact reflector antenna which includes a frequency selective subreflector to provide a plurality of antenna patterns from a single reflector antenna.

2. Description of the Prior Art

Reflector antennas are frequently used on spacecraft to provide communication links with the ground or other spacecraft's. A single spacecraft will typically house multiple antennas to provide multiple communication links. These multiple antennas on a single spacecraft typically operate at different frequencies and are used for uplink and downlink communications with the earth.

Referring to FIGS. 1 & 2, one method of providing multiple frequencies and multiple communication capabilities on a single spacecraft is to utilize a frequency sensitive structure 10, also known as a dichroic structure, as the subreflector 10 in a cassegrain type reflector antenna 12. A cassegrain type reflector antenna 12 has a main reflector 14 and a smaller subreflector 10. The dichroic subreflector 10 is hyperbolic in shape and has two focal points 16, 17 one located on each side of the subreflector 10. The subreflector 10 is placed between the main reflector 12 and the focal point 18 of the main reflector 12 with the convex side 20 of the subreflector 10 facing the main reflector 14. The focal point 16 on the concave side 22 of the subreflector 10 is placed at the focal point 18 of the main reflector 14, and, a downlink feed 24, radiating a downlink RF signal at a first frequency, depicted by the lines marked 26, is placed at the focal points 16, 18. The dichroic subreflector 10 is configured to pass the downlink RF signal 26 through the subreflector 10 so that the downlink RF signal 26 will be incident on the main reflector 14 which generates therefrom a downlink antenna pattern at the first frequency.

An uplink feed 28, radiating an uplink RF signal, depicted by the lines marked 30, at an uplink frequency, is placed at the focal point 17 of the convex side 20 of the subreflector 10. The dichroic subreflector 10 is configured to reflect the uplink RF signal 30 and redirect it towards the main reflector 14 such that the uplink RF signal 30 will be incident on the main reflector 14 which generates therefrom an uplink antenna pattern at the uplink frequency. In this way, a single reflector 14 can provide antenna patterns at two separate frequencies.

The uplink and downlink RF signals are typically generated by electronics 34 which are positioned near the reflector 14. To provide the uplink and downlink RF signals to the uplink 28 and downlink 24 feeds typically requires waveguides 32, 36 coupled between the electronics compartment 34 and the uplink 28 and downlink 24 feeds. This antenna 12 requires a long waveguide run 32 from the electronics package 34 to the downlink feed 24 which is lossy, causes design difficulties in the antenna 12 by increasing the structural, temperature and EMI/EMC protection needed by the antenna 12. It also increases manufacturing costs, volume and size required by the antenna 12 as well as the weight of the antenna.

A need exists to have a single reflector antenna having reduced cost, size, volume and weight which provides multiple antenna patterns at different frequencies.

SUMMARY OF THE INVENTION

The aforementioned need in the prior art is satisfied by this invention, which provides a multi-pattern reflector antenna for generating first and second antenna patterns from first and second RF signals having first and second frequencies of operation respectively. A multi-pattern reflector antenna, in accord with the invention, comprises a reflector having a focal point, first and second subreflectors and first and second feeds. The first and second subreflectors are positioned to image the focal point of the reflector at first and second preselected locations respectively.

The first and second subreflectors partially overlap each other with the overlapping portion of the first subreflector configured to be a frequency selective structure which reflects RF signals having the first frequency of operation and passes RF signals having the second frequency of operation. The second subreflector is configured to reflect RF signals having the second frequency of operation.

The first and second feeds are positioned at the first and second preselected locations respectively and are configured to operate at the first and second frequencies of operation respectively. The first and second feeds are configured to radiate the first and second RF signals respectively.

The first RF signal is incident upon and reflected by the first subreflector which is configured to redirect the first reflected RF signal towards the reflector. The second RF signal passes through the overlapping portion of the first subreflector and is incident upon the second subreflector which is configured to redirect the second RF signal towards the reflector.

The reflector is configured to generate first and second antenna patterns from the first and second reflected RF signals respectively.

In a first aspect, the multi-pattern antenna is configured so that the feeds are more proximate the reflector than the subreflectors.

DETAILED DESCRIPTION OF THE INVENTION

Figure 1:
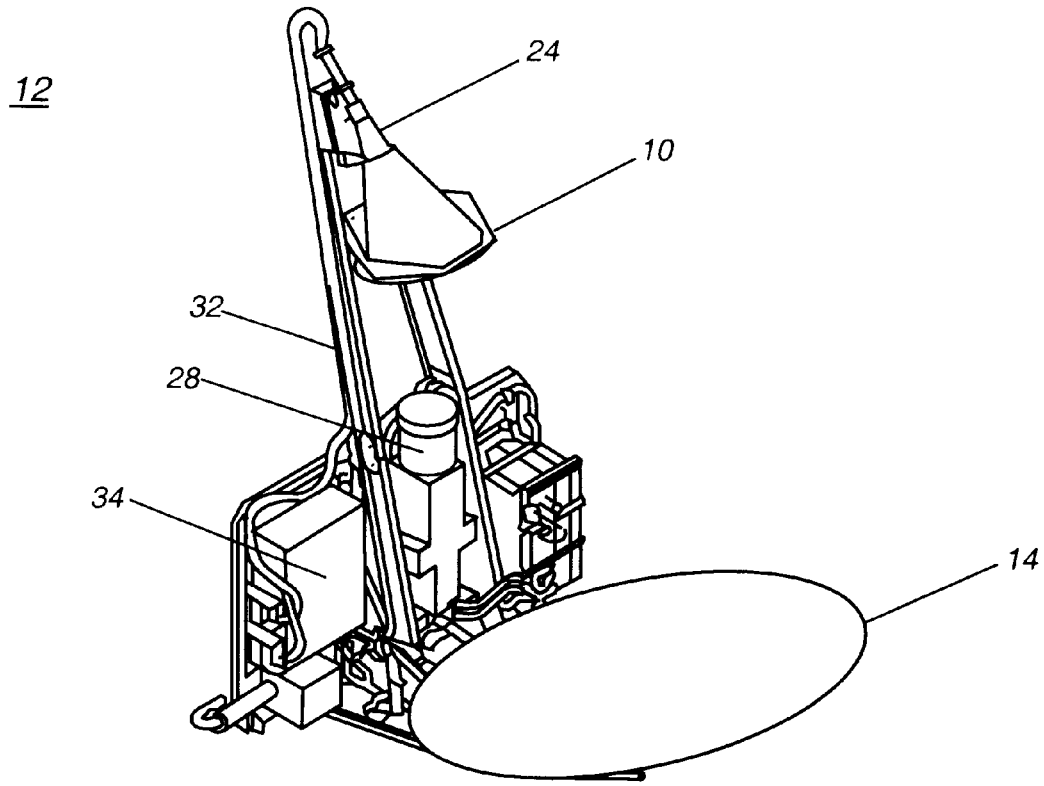
FIG. 1 is an isometric view of a prior art antenna.
Figure 2:
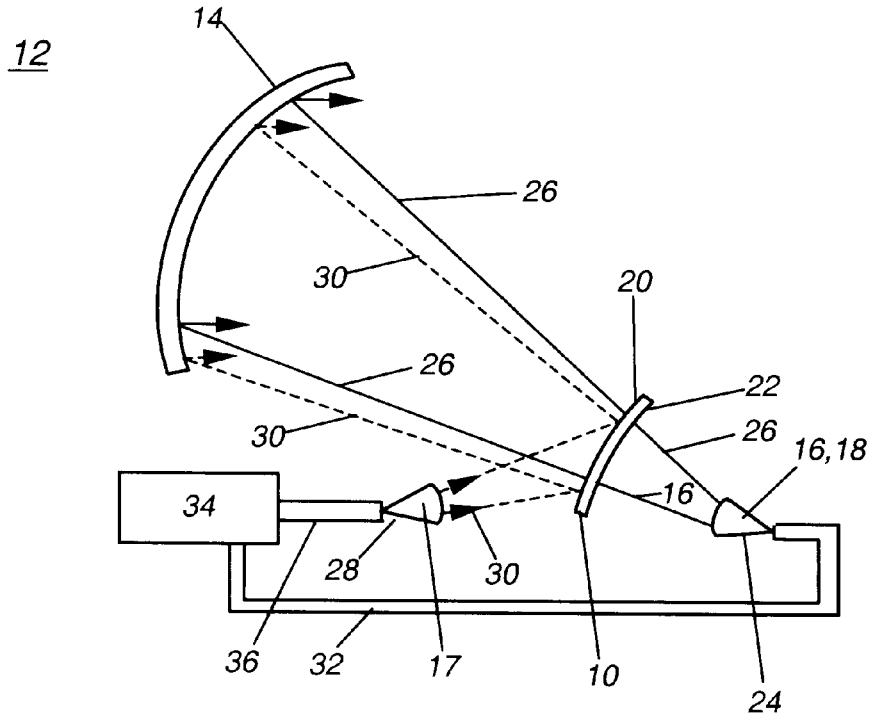
FIG. 2 is a side plane view of the prior art antenna of FIG. 1.
Figure 3:
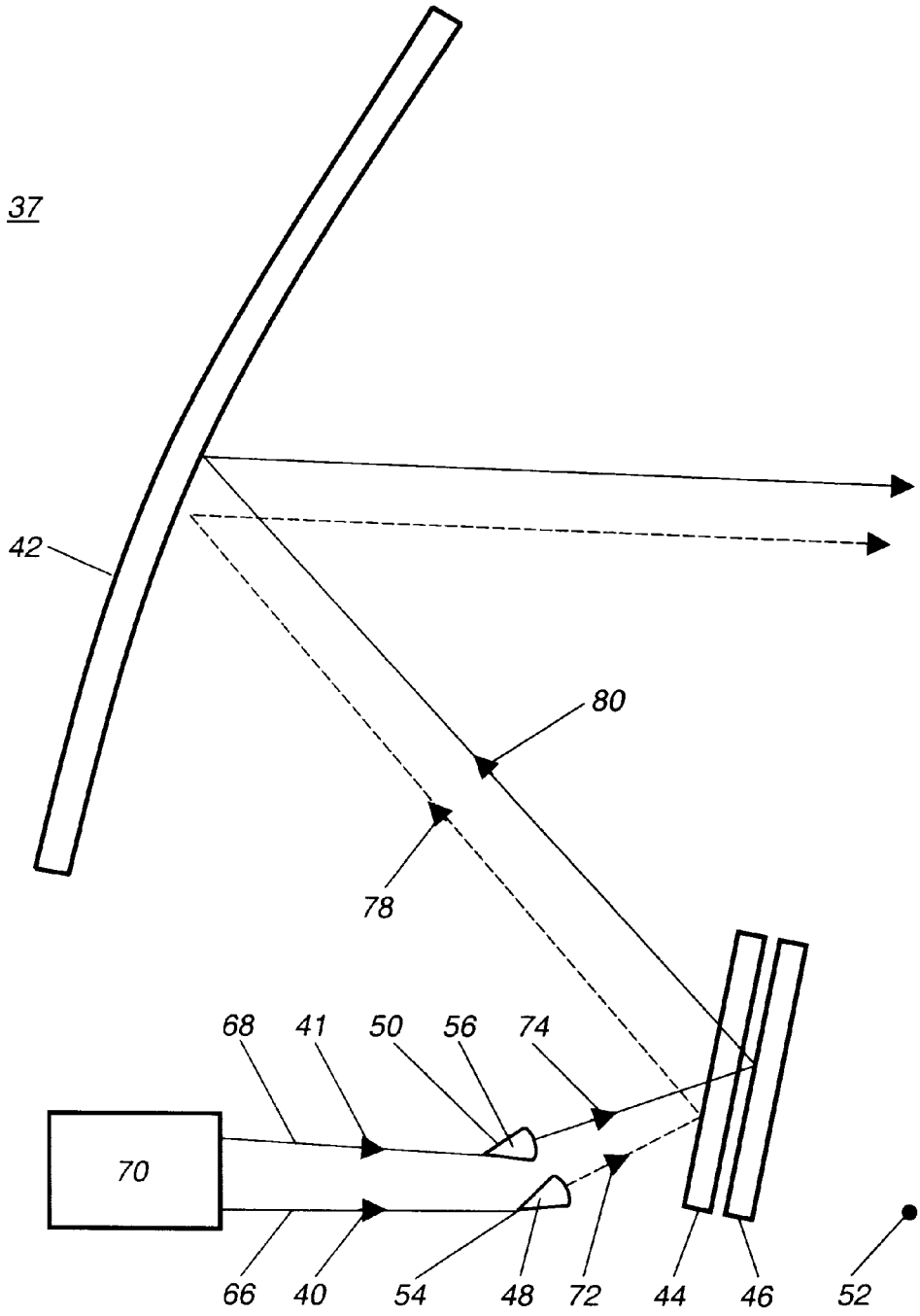
FIG. 3 is a side plane view of a multi-pattern antenna in accordance with a first embodiment of the invention.
Figure 4:
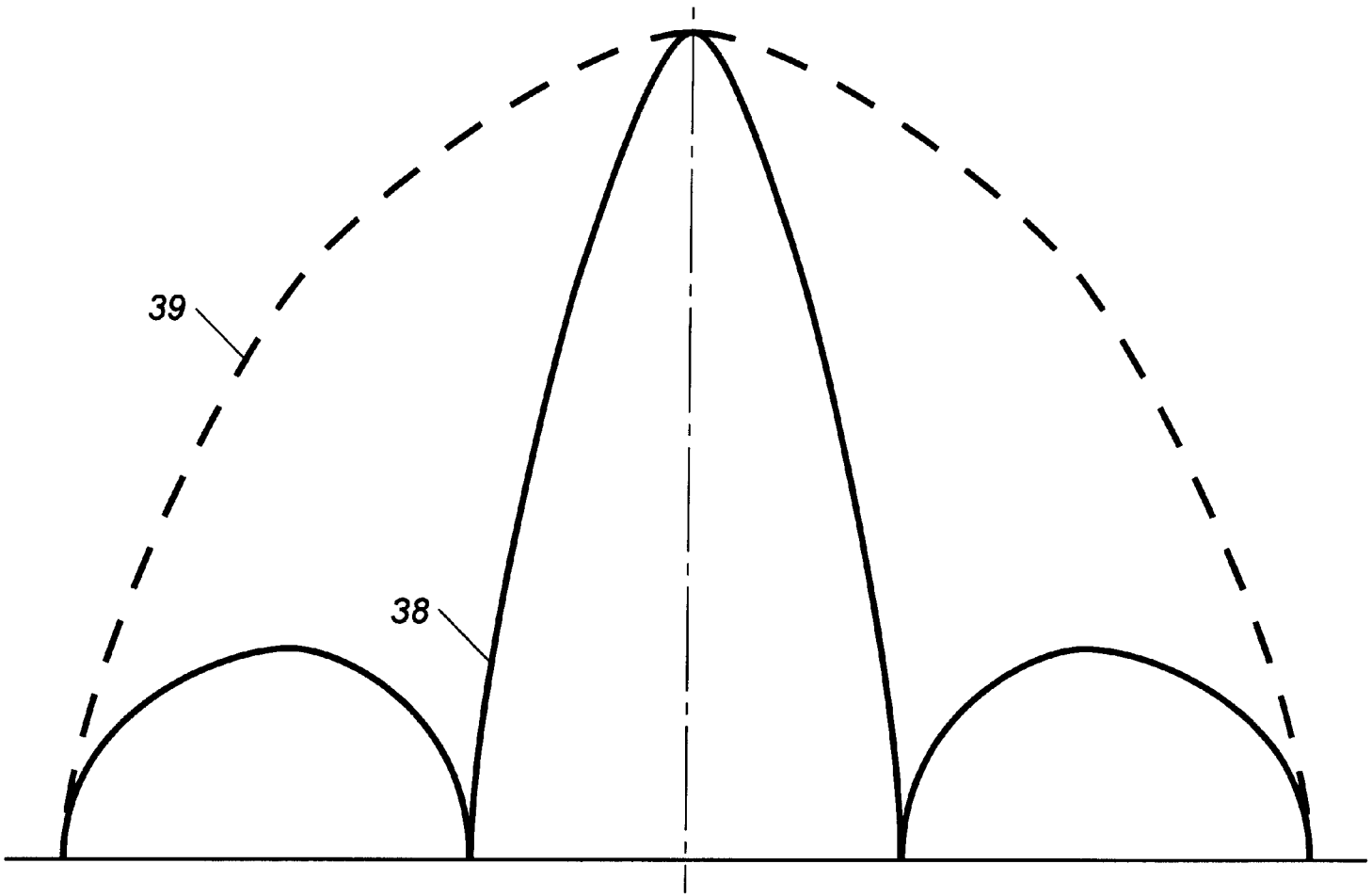
FIG. 4 shows antenna patterns generated by the antenna of FIG. 3.

Referring to FIGS. 3 & 4, a compact frequency selective reflector antenna 37 for providing multiple antenna patterns from a single compact structure is illustrated. The antenna 37 can be configured as a receive only antenna, a transmit only antenna, or a combination transmit receive antenna. For ease of explanation, the transmit only case will be described but as is known to one skilled in the art, the same concepts apply for the other configurations.

The antenna 37 is configured to provide first 38 and second 39 antenna patterns from first 40 and second 41 RF signals respectively. The antenna 37 includes a reflector 42, a first 44 and second 46 subreflectors and first 48 and second 50 feeds. The reflector 42 is preferably configured in an offset parabolic configuration having a focal point 52 which is offset from the reflector 42, but can be any reflector configuration known to one skilled in the art.

The first 44 and second 46 subreflectors are offset from each other and are preferably configured as separate structures which are each held in a preselected location by a support structure (not shown). The first subreflector 44 is configured as a frequency selective structure which reflects RF signals having the first frequency of operation and passes RF signals having the second frequency of operation. The first subreflector 44 is additionally configured and positioned to provide an image of the focal point 52 at a first preselected imaged location 54; and, the second subreflector 46 is configured and positioned to provide an image of the focal point 52 at a second preselected imaged location 56. Typically, the position of each subreflector 44, 46 results in the subreflectors 44, 46 overlapping each other.

Each subreflector 44, 46 can be in the shape of a flat plate or in the shape of a hyperbola with the exact shape and position of each subreflector 44, 46 being determined by the desired location of the first 54 and second 56 imaged locations. The exact shape and position of each subreflector 44, 46 is selected with the aid of a computer program such as GRASP, which is commercially marketed by TICRA.

First 48 and second 50 feeds are positioned at or about the first 54 and second 56 imaged locations respectively. Each feed 48, 50 can be a single feed horn, a cluster of feed horns, or any other radiating means known to one skilled in the art to be used with a reflector type antenna. The first 48 and second 50 feeds are adapted to receive first 40 and second 41 RF signals at first and second frequencies of operation respectively, which are preferably approximately 20 and 30 GHz respectively.

Each feed 48, 50 is coupled to a waveguide, depicted by the lines marked 66 & 68 respectively, which is coupled to an electronics package 70. The electronics package 70 generates the first 40 and second 41 RF signals and provides them to the first 48 and second 50 feeds respectively. The waveguides 66, 68 are typically lossy and, as such, it is desirable to minimize the length of each waveguide run 66, 68. Thus, for the preferred embodiment of the invention, the first 54 and second 56 preselected imaged locations are selected to be as close to the electronics package 70 as possible to minimize waveguide losses.

The first feed 48 is responsive to the first RF signal 40 and is operative to radiate a first RF signal, depicted by the line marked 72. The first feed 48 is configured and positioned to illuminate the first subreflector 44 with the first radiated RF signal 72. The second feed 50 is responsive to the second RF signal 41 and is operative to radiate the second RF signal as depicted by the line marked 74. The second feed 50 is configured and positioned to illuminate the second subreflector 46 with the second radiated RF signal 74.

The first subreflector 44 is configured as a frequency selective structure which reflects RF signals having the first frequency of operation and passes RF signals having the second frequency of operation. As such, the first radiated RF signal 72 is incident on the first subreflector 44 which reflects the first radiated RF signal 72 and redirects the first radiated RF signal 72 towards the reflector 42, as depicted by the line marked 78, and the second radiated RF signal 74 passes through the second subreflector 46. The redirected first RF signal 78 is incident on the reflector 42 and is reflected by the reflector 42 which generates therefrom the first antenna pattern 38. The configuration and shape of the reflector 42 is selected to provide a first antenna pattern 38 which has a preselected beamwidth and is at the same frequency of operation as the first RF signal 40.

The second radiated RF signal 74 passes through the portion of the first subreflector 44 which overlaps the second subreflector 46 and is incident on the second subreflector 46. The second subreflector 46 is configured to redirect the second radiated RF signal 74 towards the reflector 42 as indicated by the line marked 80.

In practice, it is difficult to fabricate a perfect frequency selective structure. As such, a portion of the first RF signal 72 may pass through the first subreflector 44 and be incident on the second subreflector 46. If the portion of the first RF signal 72 which passes through the first subreflector 44 is redirected towards the reflector 42, it can interfere in an undesirable manner with the first redirected signal 78. To prevent this, for the preferred embodiment of the invention, the second subreflector 46 is configured as a frequency selective structure which passes RF signals 72 having the first frequency of operation and reflects RF signals 74 having the second frequency of operation.

Typically, the path between the second subreflector 46 and the reflector 42 is at least partially obstructed by the first subreflector 44. As mentioned above, for the preferred embodiment of the invention, substantially the entire first subreflector 44 is configured to pass RF signals having the first frequency of operation so that the redirected second RF signal 80 passes through the portion of the first subreflector 44 which is in the path of the second redirected RF signal 80. As such, the second redirected RF signal 80 passes through any obstructing portion of the first subreflector 44 and is incident on the reflector 42 which generates therefrom an antenna pattern 39 having the same frequency of operation as the second RF signal 68.

Figure 5:
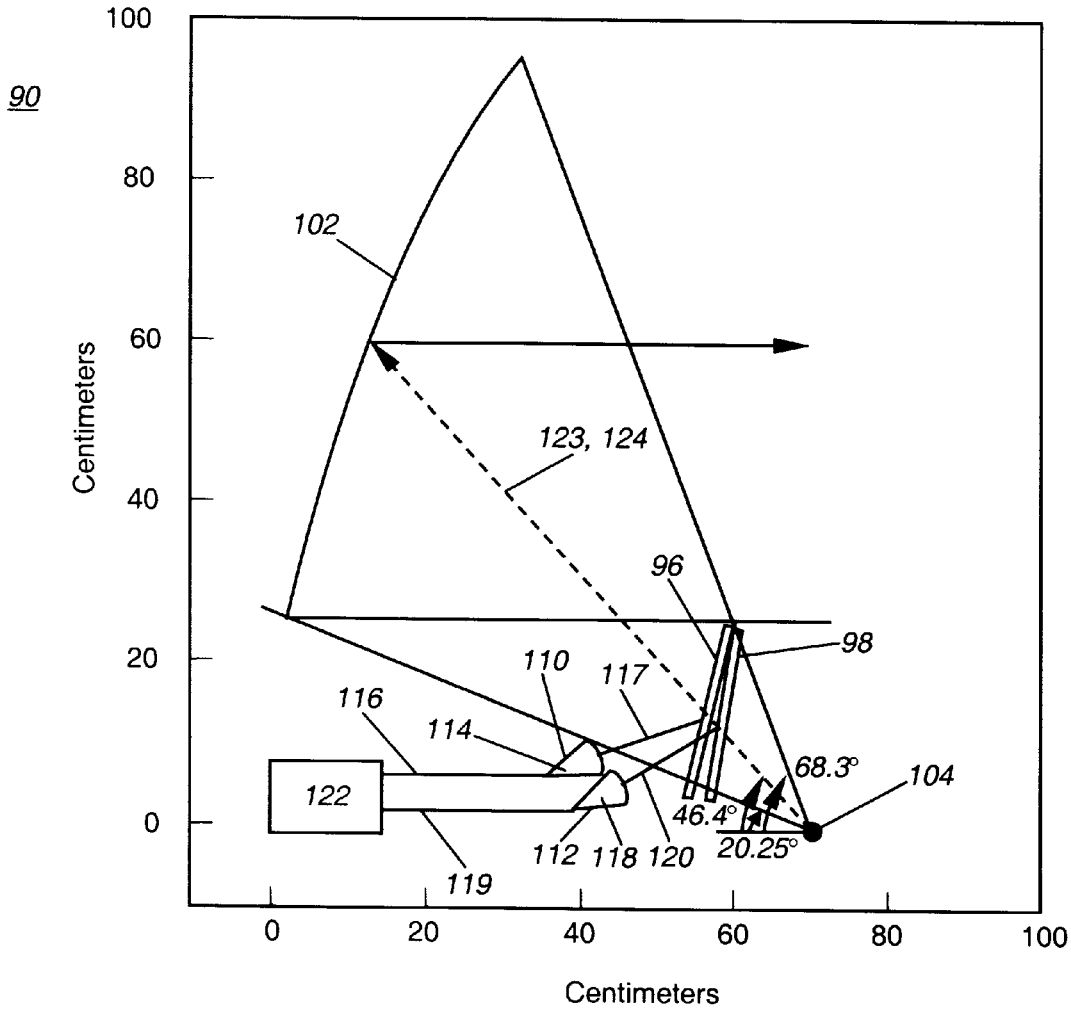
FIG. 5 is a side plane view of a multi-pattern antenna in accordance with the preferred embodiment of the invention.
Figure 6:
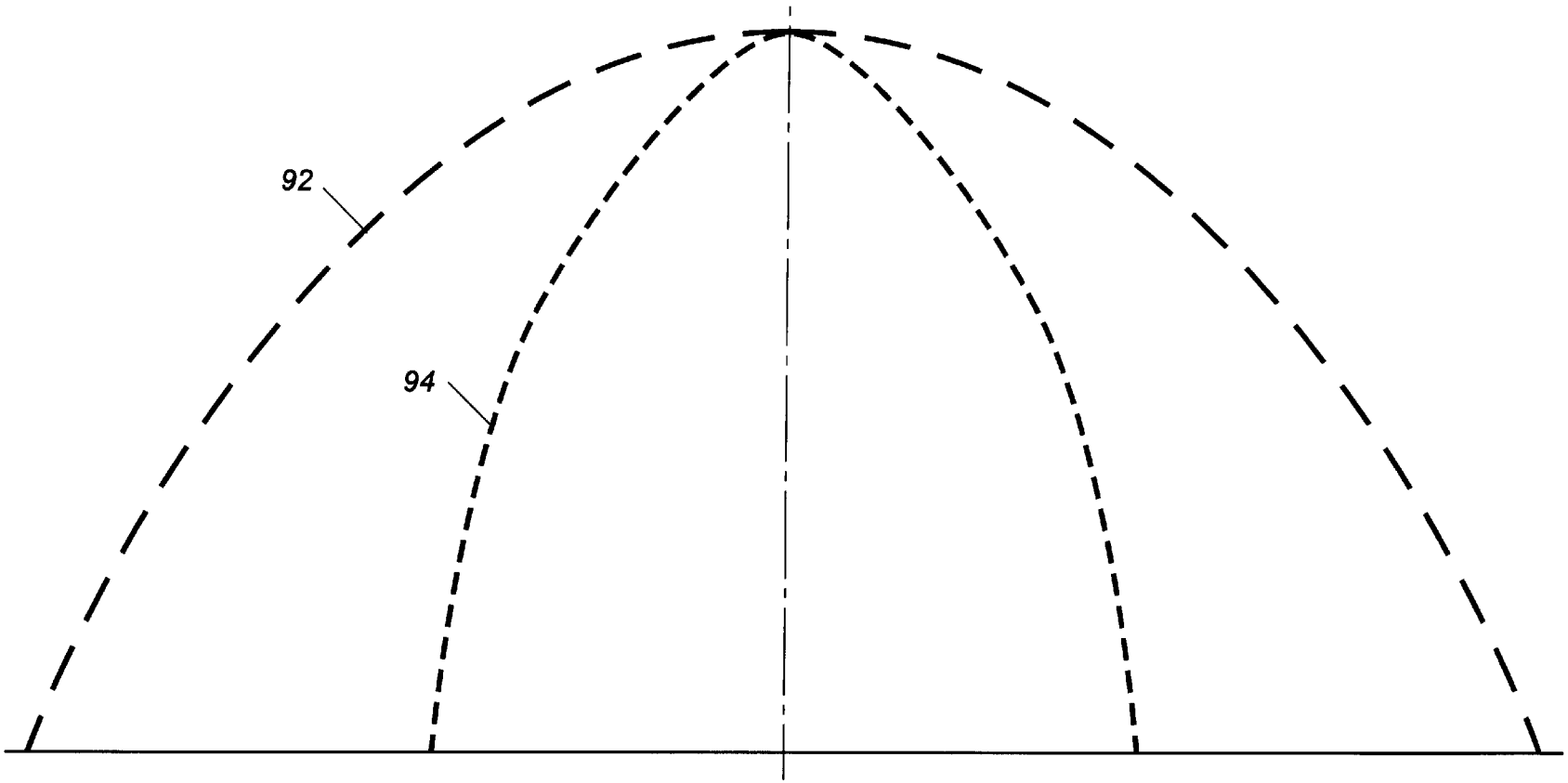
FIG. 6 shows antenna patterns generated by the antenna of FIG. 5.

Referring to FIGS. 5 & 6, for the preferred embodiment of the invention, the antenna 90 is configured to provide downlink 92 and uplink 94 antenna patterns at frequencies of approximately 20 and 30 GHz respectively. As such, the antenna 90 is configured in a transmit mode for the 20 GHz signal and in a receive mode for the 30 GHz signal. For ease of explanation, the invention will be described as if the antenna 90 is configured in the transmit mode for the 30 GHz signal. However, as is well known by one skilled in the art, the concepts described herein are easily adaptable to provide for a receive mode from the antenna 90.

The first subreflector 96 is configured to reflect RF signals having a frequency of approximately 20 GHz and pass RF signals having a frequency of approximately 30 GHz. To do so, the first subreflector 96 is typically comprised of a patterned metallic top layer over a dielectric substrate. The dielectric substrate is fabricated of materials such as Kevlar™, Nomex™, Ceramic Foam, Rohacell foam™ or the like which are commercially available materials known in the art to pass RF signals with Rohacell foam™ being fabricated by Richmond Aircraft Product Corporation located in Norwalk, Calif. To produce the patterned metallic top layer, a metallic top layer is first applied to the dielectric substrate using a vapor depositing or sputtering process and portions of the metallic top layer are removed by an etching technique thereby forming the patterned metallic top layer. A more detailed discussion of vapor depositing, sputtering and etching processes can be found in the reference cited above. Alternatively, the patterned top layer can be formed on a separate sheet of material and then bonded to the core respectively. The patterned top layer typically includes crosses, squares, circles, "Y's" or the like with the exact design and dimensions of the patterned top layer being determined by experimental data coupled with design equations and computer analysis tools such as those found in the book Frequency Selective Surface and Grid Array, by T. K. Wu, published by John Wiley and Sons, Inc.

The second subreflector 98 does not need to pass any RF signals and thus can be fabricated using standard subreflector fabrication means which are known in the art. For the preferred embodiment of the invention, the second subreflector 98 is formed of a light weight core sandwiched between two facesheets. The core and facesheets are fabricated from a material such as Kevlar™, Nomex™, honeycomb, or the like which are all commercially available materials with Kevlar™ and Nomex™ being fabricated by Hexcel Corporation located in Huntington Beach, Calif.

The antenna 90 is preferably configured in an offset cassegrain configuration where the reflector 102 is a parabolic reflector having a focal point 104 and is configured in an offset configuration at an offset height of 25 cm. The reflector 102 has an approximate 70 cm diameter and a 70 cm focal length.

The first 96 and second 98 subreflectors are flat plates which overlap each other. The first subreflector 96 is positioned as shown and images the focal point 104 at the first preselected imaged location 110. The second subreflector 98 is positioned further from the reflector 102 than the first subreflector 96 and is located at least 1.25 cm away from the first subreflector 96. The second subreflector 98 is configured to image the focal point 104 at the second preselected imaged location 112.

A first feed horn 114, is positioned at the first imaged location 110 and is coupled to a 20 GHz waveguide, depicted by the line marked 116. The first feed horn 114 has an approximately diameter of 3.8 cm and is configured to receive the 20 GHz RF signal and radiate the 20 GHz RF signal as depicted by the line marked 117. A second feed horn 118, is positioned at the second imaged location 112 and is coupled to a 30 GHz waveguide, depicted by the line marked 119. The second feed horn 118 has an approximate diameter of 2.5 cm and is configured in a receive mode. However, a previously mentioned, the embodiments of the invention will be detailed as if the antenna 90 were configured in a transmit-only mode, however, it will be obvious to one skilled in the art that the concepts apply to the receive mode as well. As such, the 20 and 30 GHz waveguides 116, 119 are coupled to an electronics package 122. The electronics package generates the 20 & 30 GHz RF signals and provides those signals to the 20 & 30 GHz waveguides 116, 119 respectively. The waveguides 116, 119 supply the 20 & 30 GHz RF signals to the first 114 and second 118 feed horns respectively.

The first subreflector 96 is configured to reflect the 20 GHz signal 117 and pass the 30 GHz signal 120. The second subreflector 98 is configured to reflect the 30 GHz signal 120 and to pass the 20 GHz signal 117. The 20 and 30 GHz radiated signals 117, 120 are incident on and reflected by the first 96 and second 98 subreflectors respectively. The reflected 20 and 30 GHz are redirected towards the reflector 102 as depicted by the lines marked 123 & 124 respectively. The redirected 20 and 30 GHz signals 123 & 124 are each incident on the reflector 102 which generates therefrom first 92 and second 94 antenna patterns at frequencies of 20 and 30 GHz respectively. For the preferred embodiment of the invention, the reflector 102, the subreflectors 96, 98 and the feeds 114, 118 are configured so that the antenna patterns 92, 94 are generated by the reflector 102 free of obstruction by the feeds 114, 118 and subreflectors 96, 98.

Figure 7:
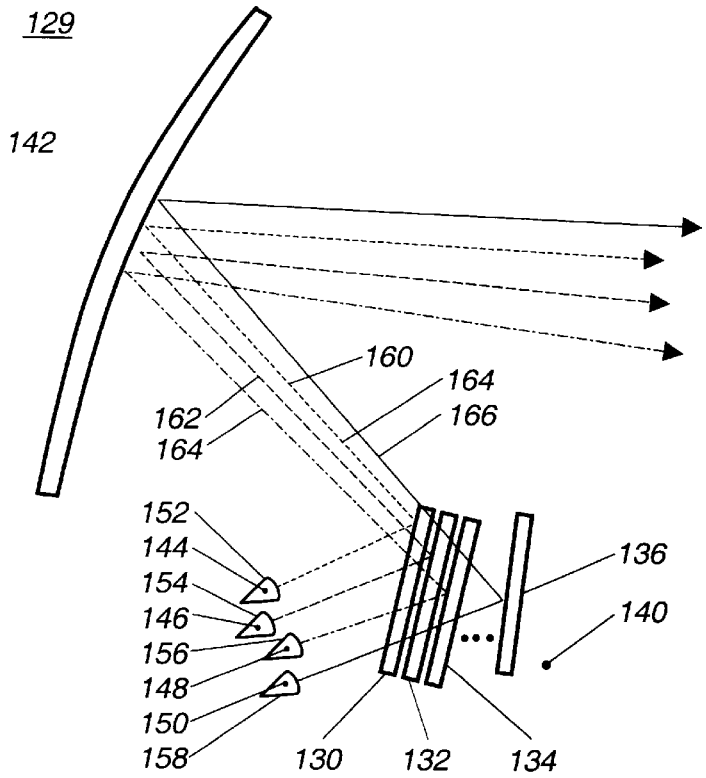
FIG. 7 is a side plane view of a multi-pattern antenna in accordance with a second embodiment of the invention.
Figure 8:
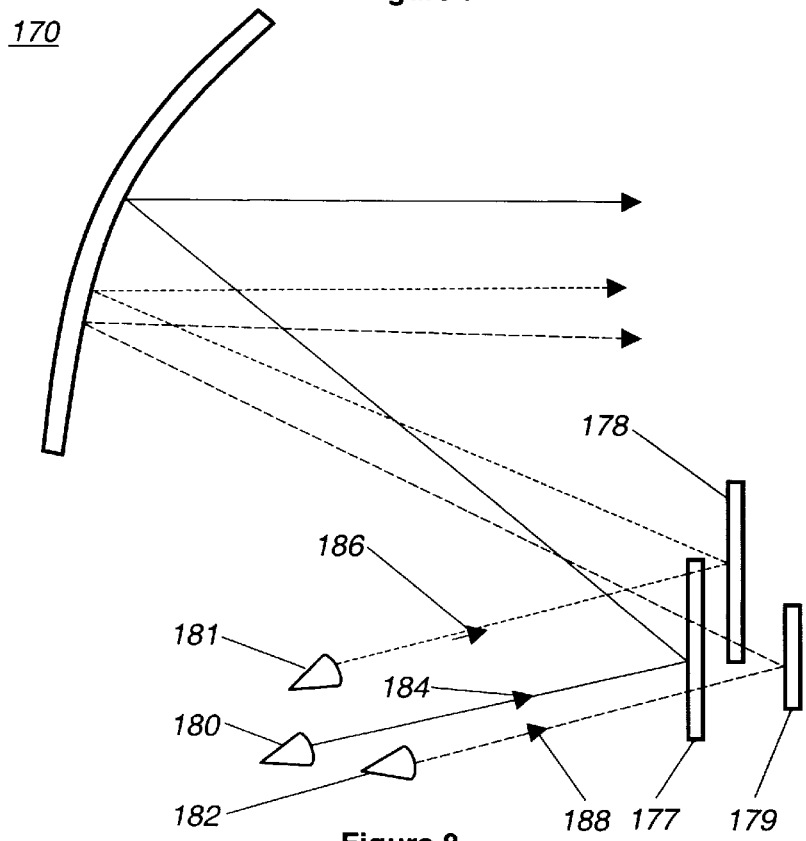
FIG. 8 is a side plane view of a multi-pattern antenna in accordance with a third embodiment of the invention.
Figure 9:
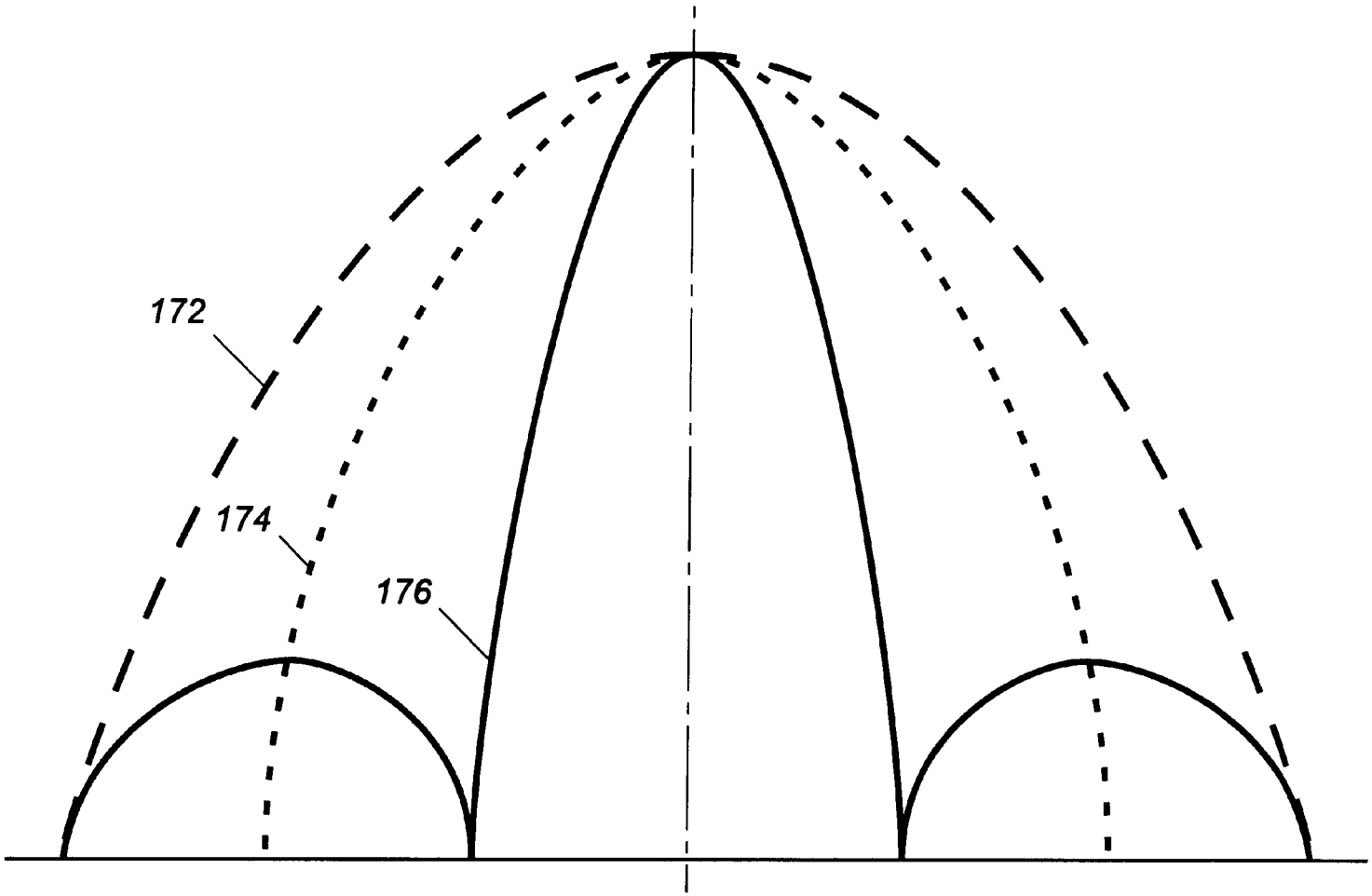
FIG. 9 shows antenna patterns generated by the antenna of FIG. 8.
Figure 10:
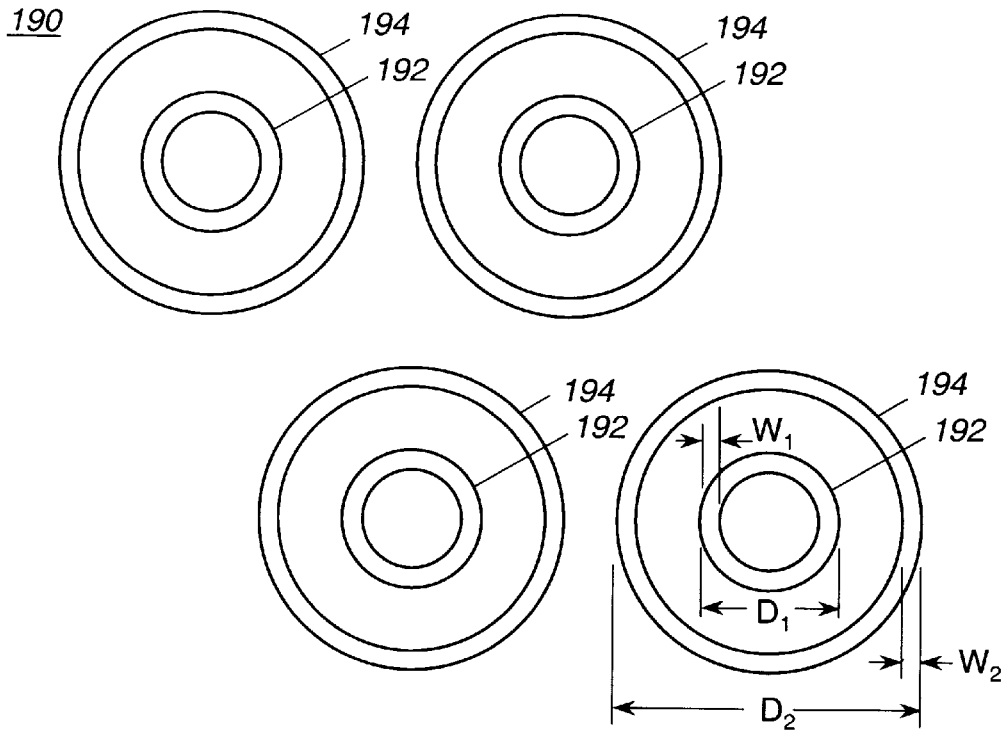
FIGS. 10 & 11 are top plan views of patterned metallic top layers in accordance with fourth and fifth embodiments of the invention.
Figure 11:
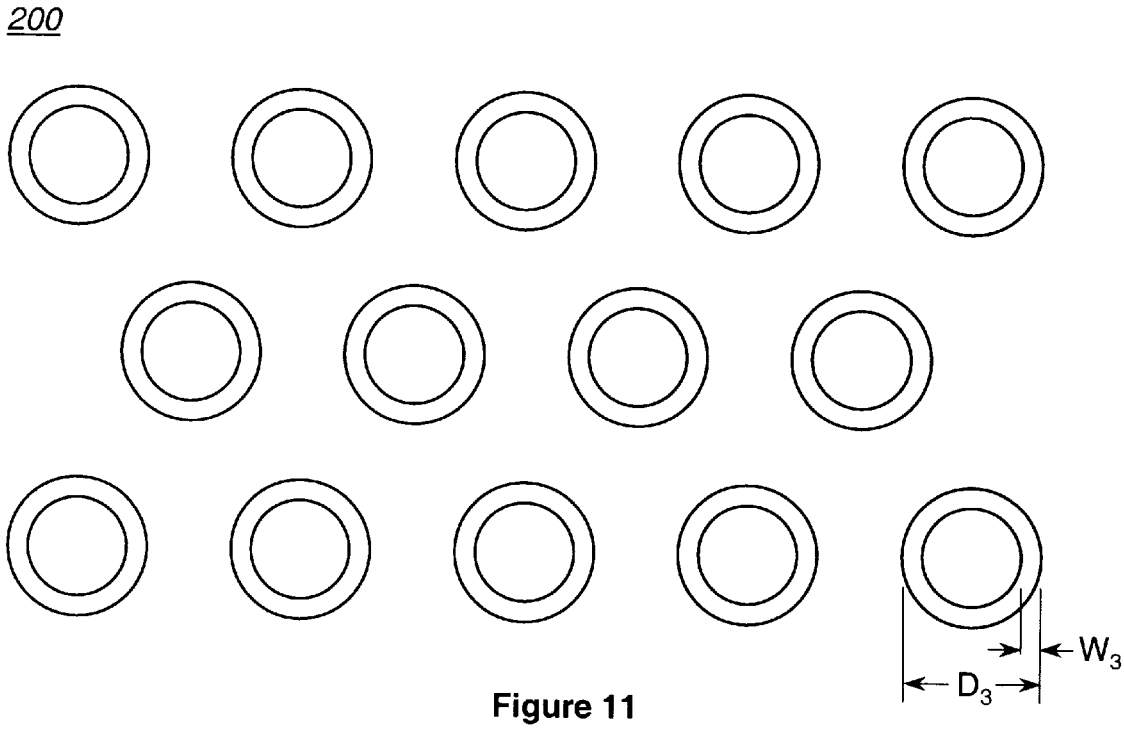

Referring to FIG. 7, for a second embodiment of the invention, the antenna 129 includes more than two subreflectors 130–136 each of which are positioned to image the focal point 140 of the reflector 142 at a different preselected imaged location 144–150 respectively. A feed 152–158 is positioned at each imaged location 144–150 respectively and each feed 152–158 is configured to radiate a separate RF signal 160–166 where each radiated RF signal 160–166 is at a different frequency of operation. The first feed 152 is configured to radiate a first RF signal 160 having a first frequency of operation, and, the second feed 154 is configured to radiate a second RF signal 162 having a second frequency of operation. Each subsequent feed 156, 158 is similarly configured to radiate an RF signal 164, 166 respectively having a preselected frequency of operation. As such, the nth feed 158 is configured to radiate the nth RF signal having an nth frequency of operation.

One of the subreflectors 130–136 at least partially overlaps another one of the subreflectors 130–136. The first subreflector 130 is configured as a frequency selective structure which reflects RF signals 160 having the first frequency of operation and passes RF signals 162–166 having the second through nth frequencies of operation. Alternatively, only the portion of the first subreflector 130 which overlaps another subreflector 132–136 is configured as a frequency selective structure. The second subreflector 132 is configured as a frequency selective structure which reflects RF signals 162 having the second frequency of operation and passes RF signals 164, 166 having the third through nth frequency of operation. Similarly, each subsequent subreflector is configured to pass and/or reflect signals of preselected frequencies. The nth subreflector 136 does not need to pass any RF signals and could therefore be configured to reflect signals of all frequencies. However, as previously mentioned, it is difficult in practice to fabricate a perfect frequency selective structure. As such, the second 132 through the nth 136 subreflectors are preferably each additionally configured to pass the first RF signal and the first through the n−1 RF signal respectively.

Referring to FIGS. 8–11, for third and fourth embodiments of the invention, the antenna 170 could be configured to generate first 172, second 174 and third 176 antenna patterns at frequencies of 20, 30 and 44 GHz respectively. The antenna 170 comprises three subreflectors 177–179 and three feeds 180–182. The first 180, second 181 and third 182 feeds are configured to provide first 184, second 186 and third 188 radiated RF signals at frequencies of approximately 20, 30 and 44 GHz respectively.

The first subreflector 177 is configured as a frequency selective structure which reflects RF signals having a frequency of approximately 20 GHz and passes RF signals having frequencies of 30 and 44 GHz. As such, the first RF signal 184 is reflected by the first subreflector 177, and, the second 186 and third 188 RF signals pass through the first subreflector 177. To do so, the first subreflector 177 preferably comprises a patterned metallic top layer over a dielectric core. The patterned metallic top layer could consist of a plurality of nested circular loops 190 where each nested circular loop 190 is comprised of an inner loop 192 and an outer loop 194. Each inner loop 192 has a diameter D1 and a width W1, and, each outer loop 194 has a diameter D2 and width W2 where D1<D2 and W1<W2 with the exact dimensions of each circular loop 192, 194 being determined with the aid of the computer program mentioned above. Properly dimensioned, the nested circular loops 190 will pass RF signals having a frequency of 30 and 44 GHz and reflect RF signals having a frequency of 20 GHz. Nested circular loops 190 are preferred for embodiments which pass and reflect RF signals which are closely spaced in frequency.

The second subreflector 178 is configured as a frequency selective structure which reflects RF signals having a frequency of operation of approximately 30 GHz and passes RF signals having a frequency of operation of approximately 44 GHz. As such, the second RF signal 186 is reflected by the second subreflector 178, and, the third RF signal 188 passes through the second subreflector 178. To do so, the second subreflector 178 preferably comprises a patterned metallic top layer over a dielectric core. The Patterned metallic top layer of the second subreflector 178 could consist of a plurality single circular loops 200, each of which having a diameter D3 and a width W3 with the exact dimensions of each circular loop 200 being determined with the aid of the above mentioned computer program. Properly dimensioned, these single circular loops 200 will pass RF signals having frequencies of 44 GHz but will reflect RF signals having a frequency of 30 GHz.

The third subreflector 179 is configured to reflect RF signals having a frequency of operation of approximately 44 GHz. As such, the third RF signal 188 is reflected by the third subreflector 179. The third subreflector 179 does not need to pass any RF signals and can thus be fabricated using standard techniques known to one skilled in the art as detailed above.

The first 184, second 186 and third 188 radiated RF signals are redirected towards the reflector 189 by the first 177, second 178 and third 179 subreflectors respectively. The reflector 189 generates first 172, second 174 and third 176 antenna patterns from the first 184, second 186 and third 188 radiated RF signals at frequencies of approximately 20 GHz, 30 GHz and 44 GHz respectively. In this manner, multiple antenna patterns 172–176 can be generated from a single reflector 189 free of the need for long waveguide runs.

It will be appreciated by persons skilled in the art that the present invention is not limited to what has been shown and described hereinabove. The scope of the invention is limited solely by the claims which follow.

I claim as my invention:

1. An antenna for providing first and second antenna at first and second frequencies of operation respectively, the antenna comprising:

a main reflector having a focal point;

first and second subreflectors configured to image said focal point at first and second preselected locations respectively, said first and second subreflectors partially overlapping each other, the first subreflector configured to be a frequency selective structure which reflects RF signals having said first frequency of operation and passes substantially all of an RF signal having said second frequency of operation, said second subreflector configured to reflect RF signals having said second frequency of operation and passes substantially all of an RF signal having said first frequency of operation; and, first and second feeds configured to operate at said first and second frequencies of operation respectively.

2. An antenna in accordance with claim 1, wherein said first frequency is approximately 20 GHz and said second frequency is approximately 30 GHz.

3. An antenna for providing first and second antenna patterns at frequencies of operation of approximately 20 GHz and 30 GHz respectively, the antenna comprising:

a main reflector having a focal point;

first and second subreflectors configured to image said focal point at first and second preselected locations respectively, said first and second subreflectors partially overlapping each other, the first subreflector configured to be a frequency selective structure which reflects RF signals having said approximately 20 GHz frequency of operation and passes RF signals having said approximately 30 GHz frequency of operation, said second subreflector configured to reflect RF signals having said approximately 30 GHz frequency of operation and pass RF signals having said approximately 20 GHz frequency of operation; and, first and second feeds located more proximate said reflector than said subreflectors and configured to operate at said approximately 20 GHz and 30 GHz frequencies of operation respectively.

4. An antenna as in claim 3, wherein said subreflectors and feeds are positioned so that said first and second antenna patterns are generated by said reflector free of obstruction by said subreflectors and feeds.

5. An antenna in accordance with claim 4, wherein the positions of said reflector, subreflectors and feeds define an offset cassegrain configuration.

6. An antenna as in claim 3, wherein said first and second feeds are located on the same side of said first and second subreflectors.

7. An antenna as in claim 6, wherein said first and second subreflectors are offset from each other.

8. An antenna for providing a plurality of antenna patterns each of which having a different frequency of operation, one of which having a first frequency of operation and a second of which having a second frequency of operation, the antenna comprising:

a main reflector having a focal point;

a plurality of subreflectors each configured to image said focal point at a different preselected location, a first one of said subreflectors overlapping a second one of said subreflectors, the overlapping portion configured to be a frequency selective structure which reflects RF signals having said first frequency of operation and passes substantially all of an RF signal having said second frequency of operation, a second one of said subreflectors configured to reflect RF signals having said second frequency of operation and pass substantially all of an RF signal having said first frequency of operation; and, a plurality of feeds, each of which is configured to operate at one of said frequencies of operation, one of which is configured to operate at said first frequency and another of which is configured to operate at said second frequency.

9. An antenna in accordance with claim 8, wherein said first frequency is approximately 20 GHz and said second frequency is approximately 30 GHz.

10. An antenna in accordance with claim 9, wherein another frequency of operation is approximately 44 GHz.

11. An antenna for providing a plurality of antenna patterns from a plurality of RF signals each of which having a different frequency of operation, one of which having a first frequency of operation and a second of which having a second frequency of operation, the antenna comprising:

a main reflector having a focal point;

a plurality of subreflectors each configured to image said focal point at a different preselected location, a first one of said subreflectors overlapping a second one of said subreflectors, the overlapping portion configured to be a frequency selective structure which reflects RF signals having said first frequency of operation and passes RF signals having said second frequency, a second one of said subreflectors configured to reflect RF signals having said second frequency of operation and pass RF signals having said first frequency of operation; and, a plurality of feeds located more proximate said reflector than said subreflectors, each of which configured to operate at one of said frequencies of operation, one of which is configured to operate at said first frequency and another of which is configured to operate at said second frequency.

12. An antenna in accordance with claim 11, wherein said subreflectors and feeds are positioned so that each of said antenna patterns are generated by said reflector free of obstruction by said subreflectors and feeds.

13. An antenna in accordance with claim 12, wherein the positions of said reflector, subreflectors and feeds define an offset cassegrain configuration.

14. An antenna in accordance with claim 11, wherein each of said subreflectors are offset from one another.

15. An antenna in accordance with claim 14, wherein said plurality of feeds are located on the same side of said subreflectors.

16. An antenna for providing first and second antenna at first and second frequencies of operation respectively, the antenna comprising:

a main reflector having a focal point;

first and second subreflectors configured to image said focal point at first and second preselected locations respectively, said first and second subreflectors partially overlapping each other, the first subreflector configured to be a frequency selective structure which reflects RF signals having said first frequency of operation and passes RF signals having said second frequency of operation, said second subreflector configured to reflect RF signals having said second frequency of operation and pass RF signals having said first frequency of operation; and, first and second feeds located more proximate said reflector than said subreflectors and configured to operate at said first and second frequencies of operation, respectively.

17. An antenna for providing first and second antenna patterns at first and second frequencies respectively, the antenna comprising:

a main reflector having a focal point;

first and second subreflectors configured to image said focal point at first and second preselected locations respectively, said first and second subreflectors partially overlapping each other, the first subreflector configured to be a frequency selective structure which reflects RF signals at said first frequency and passes substantially all of an RF signal at said second frequency, said second subreflector configured to reflect RF signals at said second frequency and pass substantially all of an RF signal at said first frequency; and first and second feeds configured to operate at said first and second frequencies respectively and illuminate said first and second subreflectors respectively, whereby said second subreflector is configured to pass substantially all of said first frequency RF signal which spills over or leaks through said first subreflector and is incident on said second subreflector so that said spilled over and leaked though first frequency RF signals radiate away from said main reflector.

18. The antenna of claim 17 wherein each said subreflector has a first side facing the main reflector, each of said feeds positioned to illuminate said first side of one of said subreflectors.

19. The antenna of claim 17, wherein each said subreflector has a concave side and a convex side, each subreflector positioned so that said convex side is facing said main reflector, each of said feeds positioned to illuminate said convex side of one of said subreflectors.

* * * * *